US006256997B1

(12) United States Patent
Longsworth

(10) Patent No.: US 6,256,997 B1
(45) Date of Patent: Jul. 10, 2001

(54) REDUCED VIBRATION COOLING DEVICE HAVING PNEUMATICALLY-DRIVEN GM TYPE DISPLACER

(75) Inventor: Ralph C. Longsworth, Allentown, PA (US)

(73) Assignee: Intermagnetics General Corporation, Latham, NY (US)

( * ) Notice: Subject to any disclaimer, the term of this patent is extended or adjusted under 35 U.S.C. 154(b) by 0 days.

(21) Appl. No.: 09/504,999

(22) Filed: Feb. 15, 2000

(51) Int. Cl.[7] ..... F25B 9/00
(52) U.S. Cl. ..... 62/6; 60/520
(58) Field of Search ..... 62/6; 60/520

(56) References Cited

U.S. PATENT DOCUMENTS

| | | | |
|---|---|---|---|
| 2,906,101 | | 9/1959 | McMahon . |
| 3,119,237 | | 1/1964 | Gifford . |
| 3,620,029 | | 11/1971 | Longsworth . |
| 4,389,850 | | 6/1983 | Sarcia . |
| 4,490,974 | * | 1/1985 | Colgate ..... 62/6 |
| 4,543,793 | | 10/1985 | Chellis et al. . |
| 4,783,968 | | 11/1988 | Higham et al. . |
| 4,792,346 | | 12/1988 | Sarcia . |
| 4,819,439 | | 4/1989 | Higham . |
| 4,872,313 | * | 10/1989 | Kazumoto et al. ..... 62/6 |
| 4,922,722 | * | 5/1990 | Kazumoto et al. ..... 62/6 |
| 4,969,807 | * | 11/1990 | Kazumoto et al. ..... 62/6 |
| 5,048,297 | | 9/1991 | Sarcia et al. . |
| 5,092,119 | | 3/1992 | Sarcia . |
| 5,103,645 | | 4/1992 | Haring . |
| 5,735,128 | | 4/1998 | Zhang et al. . |
| 5,737,925 | * | 4/1998 | Sekiya et al. ..... 62/6 |

* cited by examiner

*Primary Examiner*—Ronald Capossela
(74) *Attorney, Agent, or Firm*—Helfgott & Karas, P.C.

(57) ABSTRACT

A GM type displacer has an elastomer "O" ring at the warm end to absorb impact energy when the displacer reaches the bottom of the stroke before it would hit the cylinder end cap. When the displacer reaches the top of its stroke, before the displacer would hit the internal mechanism of the expander, another elastomer "O" ring absorbs the kinetic energy of the displacer. Both absorbers are at or near ambient temperature.

13 Claims, 7 Drawing Sheets

REDUCED VIBRATION COOLING DEVICE HAVING PNEUMATICALLY-DRIVEN GM TYPE DISPLACER

BACKGROUND OF THE INVENTION:

This application relates to vibration reduction in a GM displacer/regenerator, and more particularly, relates to vibration reduction in a pneumatically-driven GM displacer/regenerator. Cryogenic refrigerators of the GM type frequently include a multi-stage displacer/regenerator as a key element in expanding high pressure gaseous refrigerant to achieve extremely low temperatures.

There is an abundance of prior art that describes various pneumatically-driven and mechanically-driven displacers and their operations in cryogenic systems and in achieving cryogenic temperatures. For example, basic principals of operation are described in the original Gifford-McMahon (GM) U.S. Pat. No. 2,906,101, issued Sep. 29, 1959. In that patent, which is incorporated herein by reference, the displacer is reciprocatingly driven in a cylinder by a conventional crank mechanism. Thus, low temperature refrigeration is effected with auxiliary equipment, such as connecting rods, crank shafts, or the like, to cycle the displacer. These mechanical parts produce mechanical vibrations that in many instances are undesirable and shorten the time between necessary maintenance or repairs.

U.S. Pat. No. 3,620,029, issued Nov. 16, 1971 by the present inventor, and incorporated herein by reference, replaces mechanical drive of the displacer with a pneumatic drive. The mechanical problems associated with the crank type drive, or cam type drive, as in other designs, are substantially eliminated and the operating life of the systems has been enhanced by such pneumatic drives. However, other mechanical problems, noise and vibration producing problems arise through the use of the pneumatically-driven displacer. These problems have roots also in the thermodynamics of the refrigeration cycle.

In a mechanically-driven or pneumatically-driven displacer/expander, the displacer includes a piston that reciprocates within a cylinder. When the piston moves to what is known as the "bottom" of the cylinder, it is most desirable thermodynamically that the clearance volume be zero, or as near to that volume as possible. Thus, unless careful control is provided for the motion of the displacer, collisions can occur between the displacer piston and the closed end of the cylinder. These collisions create noise and vibration. Also, when the displacer moves in the opposite direction, unless careful control is provided, there can be an impact when the displacer is at the "top" of its stroke. Further noise and vibration are produced. (The use of the words "top", "bottom", "up", "down", and the like does not necessarily indicate a physical orientation. No orientation is excluded from use.)

The original GM U.S. Pat. No. 2,906,101, describes a rectangular pressure-volume (P-V) diagram but actually it is best from a thermodynamic standpoint to close the inlet valve before the displacer reaches the top. This causes the gas pressure in the expander to drop before the displacer reaches the top. Similarly it is best to close the exhaust valve before the displacer reaches the bottom. This causes an increase in pressure before the displacer reaches the bottom. In a pneumatically driven expander this causes the displacer to decelerate before it reaches the end of the stroke.

Many vibration isolation systems have been developed to improve cycle efficiency and to prevent collisions between the displacer and its surroundings, or where collisions occur, to reduce vibrations caused by the impact. These include both electrical and mechanical concepts.

For example, repelling magnets have been used to constrain the motion of the displacer at the top and bottom ends of its motion. Elastomer vibration absorbers have been used with some success. However, these devices are only effective at the warm end of the displacer motion, but are not able to operate effectively at the cryogenic temperatures. Therefore, impact forces at the cold end have been absorbed, for example, using delrin plastic pads, which can take the low temperatures. However, there is still a considerable impact and vibration problem when using delrin absorbers. Such impacts and vibrations have been known to affect the quality and resolution of images obtained in MRI apparatuses that use cryogenically cooled magnets.

What is needed is an improved expander that has the advantages of a simplified pneumatic drive, long operating life, low vibration in operation and an efficient thermodynamic cycle.

SUMMARY OF THE INVENTION

In accordance with the invention, a displacer in a GM expander has a pneumatic drive that reduces the speed of the displacer before it hits at the top and bottom of the stroke. This velocity control is accomplished by closing the inlet and exhaust valves after the displacer has traveled about two-thirds of its stroke. Thereby driving pressure difference is reduced and the displacer slows down before hitting the top (warm end) and bottom (cold end) of the cylinder.

Historically, bumpers machined from delrin have been installed at the top and bottom of the cylinder to absorb some of the impact energy of the reciprocating displacer. Within the past few years, manufacturers have started to use "O" rings or an equivalent elastomer material to absorb the impact energy at the top end where the temperature is near room ambient. Unfortunately, elastomer materials become every rigid at the cold end temperatures so that machined bumpers of delrin continue to be used at the cold end.

In the present invention, an elastomer "O" ring, or other elastomer shape is used at the warm end to absorb the impact energy when the displacer reaches the bottom (cold end) of the stroke, before it hits the cylinder end cap. Also, when the displacer reaches the top of its stroke, before the displacer hits the internal mechanisms of the expander, another elastomer "O" ring absorbs the kinetic energy of the displacer. It has been reported that the resultant reduction in vibration by using two resilient "O"rings, reduces the electrical noise imparted to an MRI signal by more than fifty percent.

Accordingly, it is an object of the present invention to provide an improved expander/displacer unit that is a low producer of mechanical vibration and noise.

Yet another object of the invention is to provide an improved expander/displacer that is pneumatically driven and thereby has extended operating life and simplified construction.

Yet another object of the invention is to provide an improved expander/displacer that provides a refrigeration cycle of relatively high efficiency.

Still other objects and advantages of the invention will be apparent from the specification.

The invention accordingly comprises the features of construction, combinations of elements, and arrangement of parts, which will be exemplified in the constructions hereinafter set forth, and the scope of the invention will be indicated in the claims.

BRIEF DESCRIPTION OF THE DRAWINGS

For a fuller understanding of the invention, references had to the following description taken in connection with the accompanying drawings, in which.

Figure 1A:
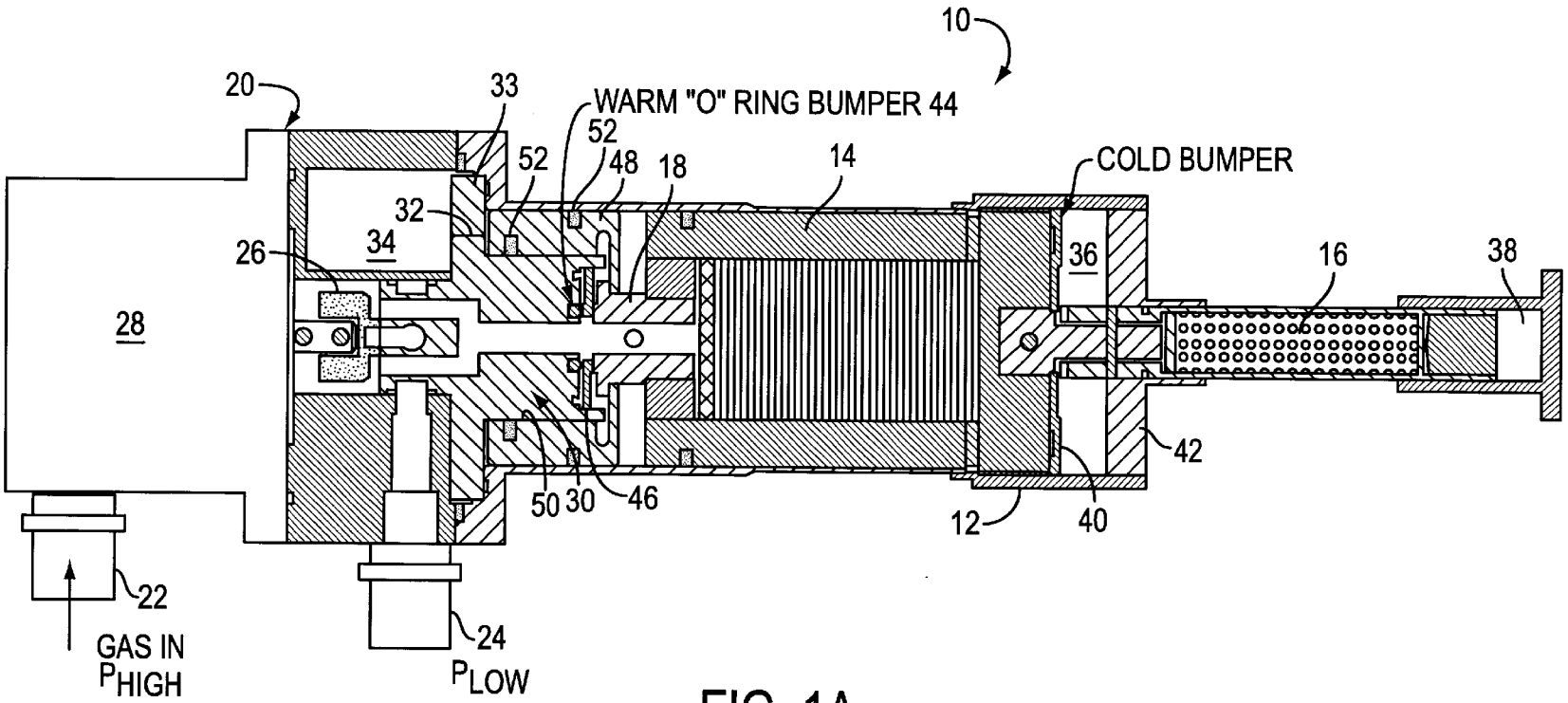
FIG. 1A (PRIOR ART)
FIG. 1*a* is a sectional view of a pneumatically driven GM type expander of the prior art in the "top" position.

DESCRIPTION OF PREFERRED EMBODIMENTS:

In the prior art (FIG. 1*a*), a two-stage pneumatically driven GM type expander 10 includes a circular cylinder assembly 12 of e.g. stainless steel, first stage displacer/regenerator 14, and second stage displacer/regenerator 16 connected together and mounted for reciprocal motion in the cylinder assembly 12, in a construction well known in the art.

Features of displacers/regenerators that are well known in the art and are not novel portions of the present invention, are not described in great detail herein.

A drive stem 18 fixedly connects, for example, by threading, to the first stage displacer/regenerator 14. A valve assembly 20 controls the flow of refrigerant gas, for example, helium, from an inlet 22 at elevated pressure to its outlet 24 at low pressure, and includes a rotary valve 26, valve motor 28, and valve stem 30. A fixed orifice 32 through a flange 33 of the valve stem 30 connects to a surge volume 34 that is within the valve assembly 20. The valve assembly 20 is fixedly connected to the cylinder assembly 12.

FIG. 1*a* illustrates a condition where the displacers are "up" at the "top" of a stroke, as is known in the art. That is, there are within the expander a first stage gas volume 36 and a second stage gas volume 38. (The displacer assemblies 14, 16 are to the left side in the FIG. 1*a*). A bumper 40 connects to the displacer 14 and prevents direct collision of the displacer 14 with the end cap 42 of the cylinder assembly 12. The device is dimensioned so that when the bumper 40 presses against the end cap 42, the second stage displacer 16 does not make contact with the end cap 43. The bumper 40 is of shock absorbing material. However, because of the extremely cold operating temperatures, choices of materials are limited. Typically, machined delrin (trademark of DuPont Company), an acetal resin, is used for the cold bumper 40.

When the displacers 14, 16, are up as illustrated in FIG. 1*a*, the impact and vibrations of collision between the drive stem 18 and the valve stem 30 are reduced by elastomer "O" ring 44. A retainer 46, that keeps the "O"ring 44 seated in the groove of the valve stem 30, further isolates the drive stem 18 from the valve stem 30. Such a retainer is not a necessary feature of the construction when the groove in the valve stem 30 is capable of retaining the "O" ring 44, or another-shaped ring of material is used in place of the "0" ring. For example, T-shaped rings and dove tail shaped grooves may be used in place of the "O" ring/retainer that is illustrated in the Figures. "O" ring 44 is resilient, for example, made of an elastomer such as Buna N rubber. More than one "O" ring may be used. These "O" rings are located away from the gas chamber 36 where the refrigeration effect is produced, as discussed hereinafter, and may be at or near room ambient temperature. Thus, resilient material such as elastomers are useable for a bumper when the displacers move to the up position (FIG. 1*a*), are very effective in absorbing energy from the moving displacers, and thereby reduce noise and vibration.

Generally speaking, the energy that can be absorbed by an "O" ring is proportionate to the volume of material being compressed. Compression is limited to prevent fatigue of the ring.

A slack cap 48 is slidably mounted within the cylinder assembly 12 on an outside surface of the valve stem 30.

The basic principle of operation is described in the original Gifford-McMann (GM) U.S. Pat. No. 2,506,101 using a mechanically driven displacer. The present inventor's U.S. Pat. No. 3,620,029 describes means by which gas flowing to and from a surge volume causes the displacers to reciprocate without direct mechanical drive when the gas pressure is cycled by means of the valve assembly 20.

Figure 1B:
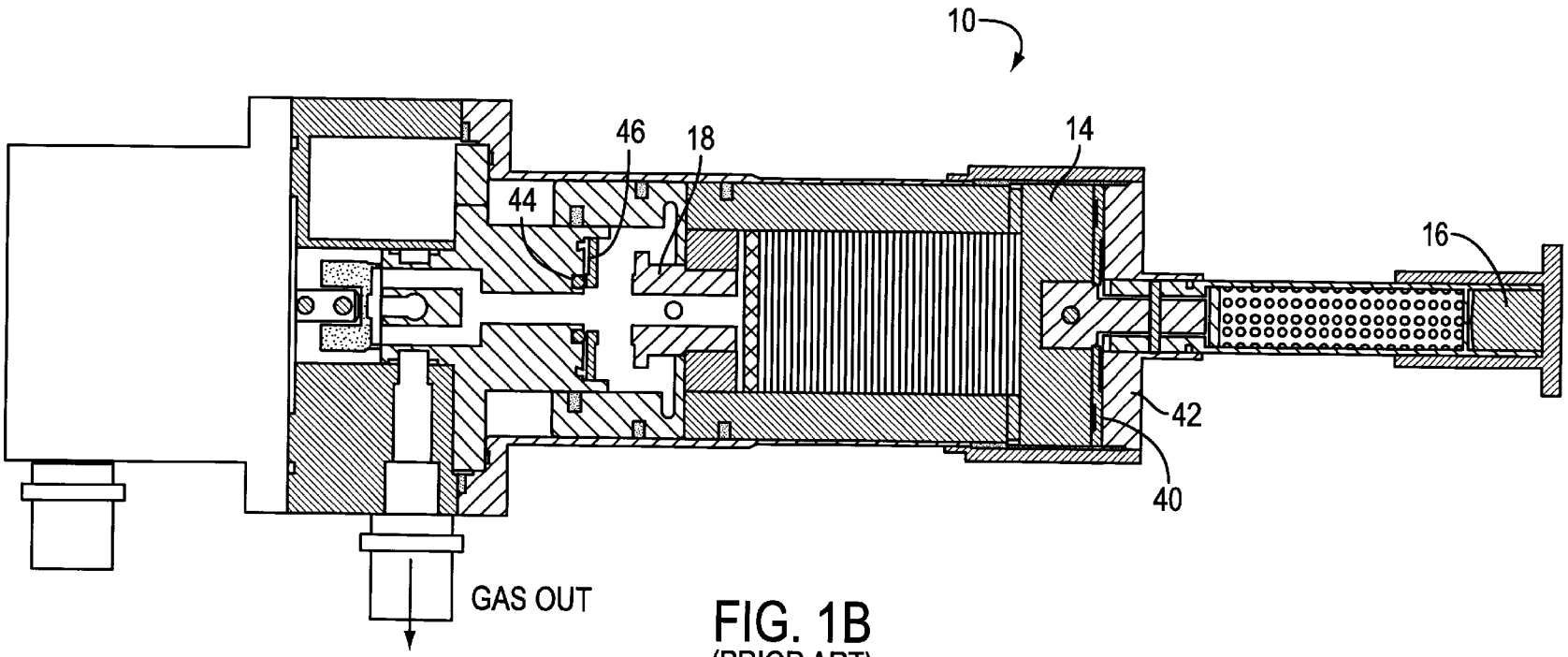
FIG. 1B (PRIOR ART)
FIG. 1*b* illustrates the expander of FIG. 1*a* in the "bottom" position.

FIG. 1*b* illustrates the same construction as FIG. l*a* except that the displacer assembly 14, 16 has translated (to the right) to the down/bottom position such that the gas volumes of chambers 36, 38 have been eliminated except for any clearance volume that may remain. The cold bumper 40 is in direct contact with the end cap 42 of the cylinder assembly 12 and the clearance volume at the end cap 43 is as small as possible without collision occurring between the displacer 16 and the end cap 43. The drive stem 18 has separated from the O-ring 44 and retainer 46.

In continuous operation, cold heads are available at two different temperature levels on the cylinder assembly 12, proximate the end caps 42, 43, all in a known manner.

Figure 2A:
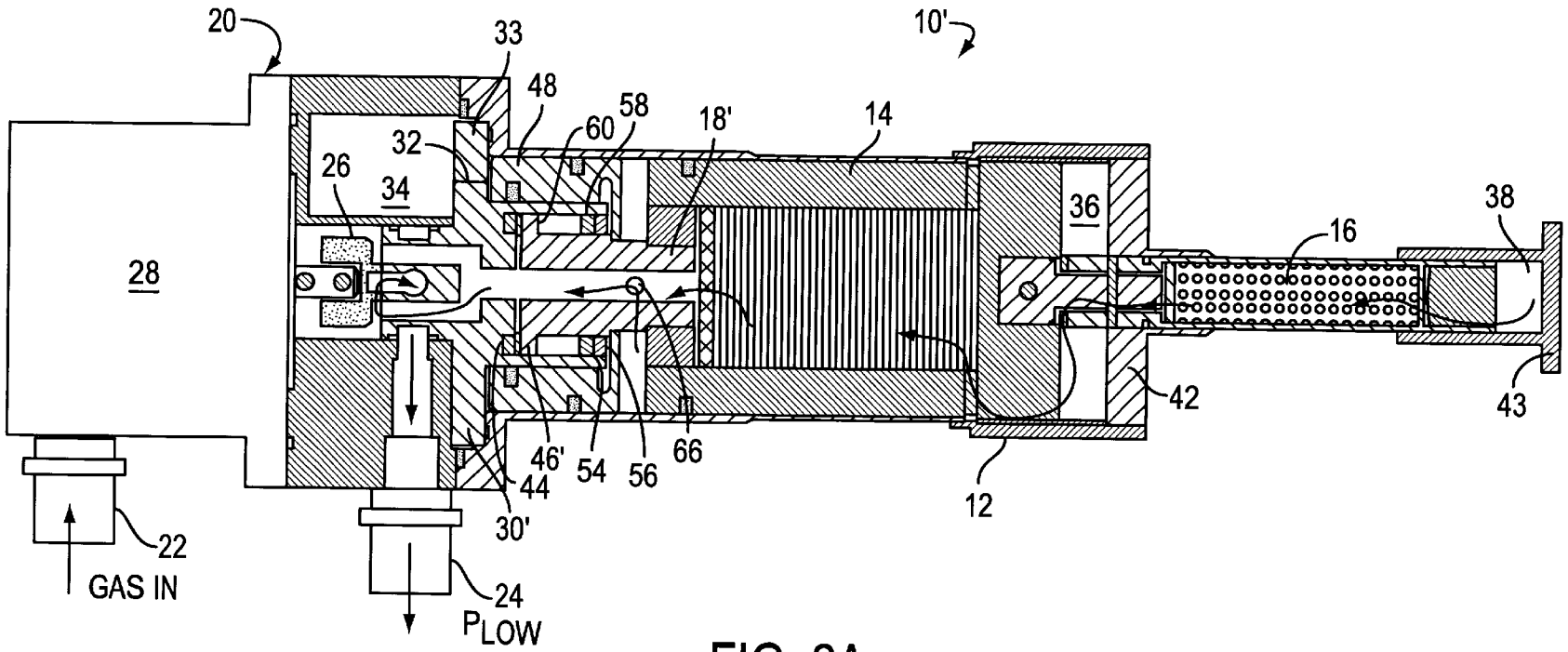
FIG. 2*a* is a sectional view of a pneumatically driven GM type expander in accordance with the invention in the "top" position.
Figure 2B:
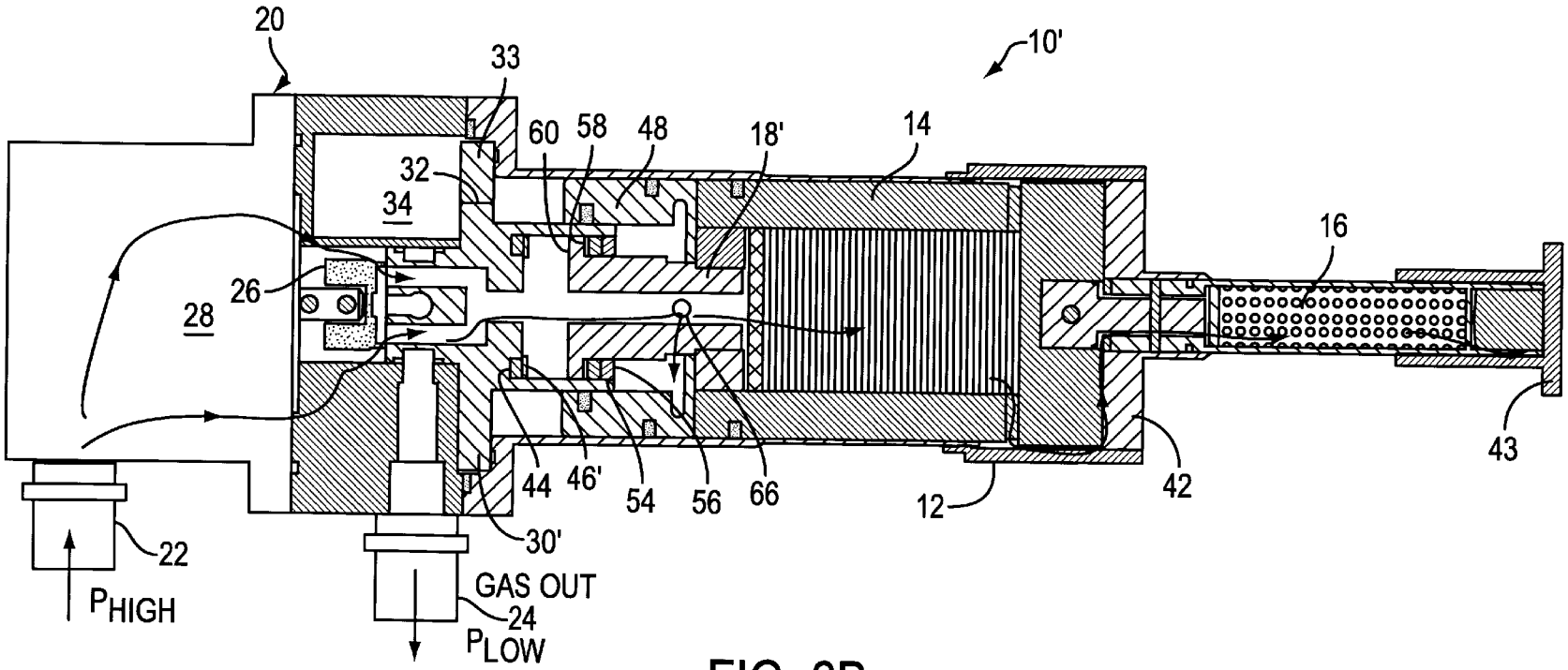
FIG. 2*b* is a view of the expander of FIG. 2*a* in the "bottom" position.
Figure 3:
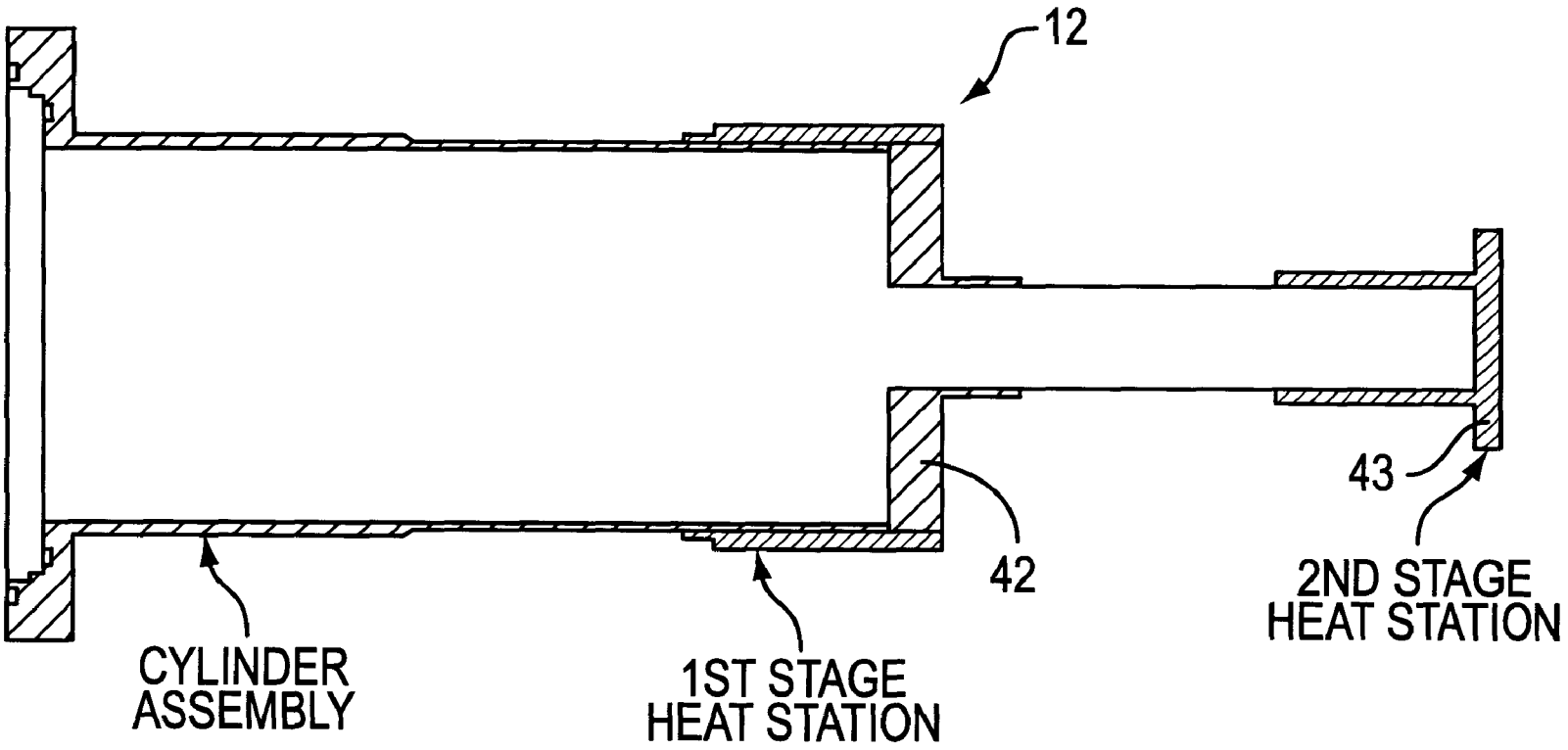
FIG. 3 illustrates a cylinder assembly as used in the embodiment of FIGS. 2*a, b;*

FIG. 2*a* illustrates the expander 10' in accordance with the invention in the up (top) position, that is with chambers 36, 38 at their maximum volumes. FIG. 2*b* illustrates the same expander 10' at the down (bottom) position with the internal volumes 36, 38 substantially eliminated after movement of the displacers 14, 16 to the right, as illustrated. The primary difference between the embodiments of FIGS. 1*a*, 1*b* and FIGS. 2*a*, 2*b* resides in replacement of the cold machined delrin bumper 40 of the prior art with a second O-ring bumper 54 that is located on the up side (warm) of the displacer assembly 14, 16.

In particular, the "O"-ring 54 (FIG. 4) is held in the grooved holder 56. A retainer 58, typically made of delrin, keeps the O-ring 54 in the groove of the holder 56, but may not be necessary when other cross-sections are used for the bumper and the groove. When the displacer assembly 14, 16 moves from the up position (FIG. 2*a*) to the down position (FIG. 2*b*), motion of the displacer assembly 14, 16 is stopped by contact of the flange 60 of the drive stem 18' against the bumper/retainer combination 54, 58. The bumper 54 is a resilient material, for example, an elastomer such as buna rubber, and the overall assembly is dimensioned such that at either end of the reciprocating stroke of the displacers 14, 16, no direct physical contact is made between the displacers and the respective end caps 42, 43.

The elastomer bumpers 44, 54 absorb considerably more energy than the prior art delrin bumper. The ability to use elastomer bumpers at both ends of the reciprocating stroke effects a substantial reduction in noise and vibration during operation of a cooling system including such an expander, as compared to the prior art (FIGS. 1*a, b*).

A description of the operating cycle follows. The displacer assembly 14, 16 of the present invention is driven pneumatically. The disadvantages of direct mechanical drive are eliminated and the life of the expander is greatly increased.

Figure 5:
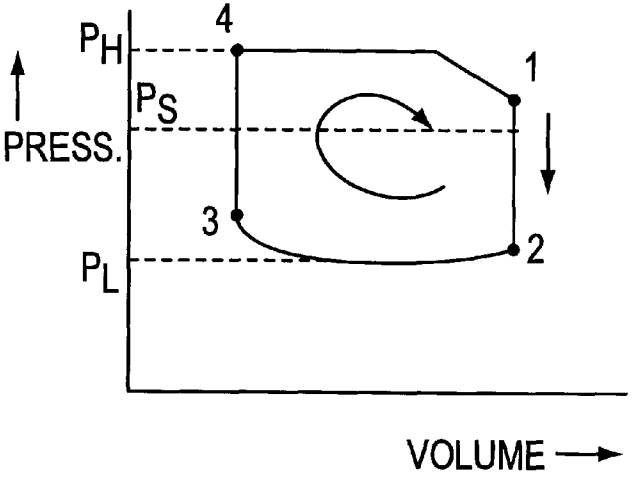
FIG. 5 is a pressure-volume (P-V) diagram illustrating a refrigeration cycle in a stage of the expander of FIGS. 2*a, b;*

The cycle is described with reference to the pressure-volume diagram of FIG. 5. The pressure and volume that are illustrated represent the conditions in the chambers 36, 38, respectively. Typically when using helium gas a high pressure Ph from a compressor is about 2 mpa (300 psi). The low pressure Pl to the compressor is about 0.8 mpa (117 psi), and pressure Ps in the surge volume 34 is approximately 1.5 mpa (220 psi).

FIG. 2*a* illustrates the displacer assembly 14, 16 at the top of the stroke. The assembly is filled with high pressure gas (helium) and is represented at point 1 of FIG. 5. The valve 26 turns and allows gas to flow back to the compressor (not shown) via the low pressure gas outlet 24. Reduced pressure between the first stage displacer 14 and the slack cap 48 causes gas from the surge volume 34 to flow through the orifice 32 and push the slack cap 48 to the right (down). Before the slack cap 48 hits the displacer 14, the gas pressure in the displacer cylinder 12 drops to approximately Pl, that is, return pressure to the compresser.

Figure 6:
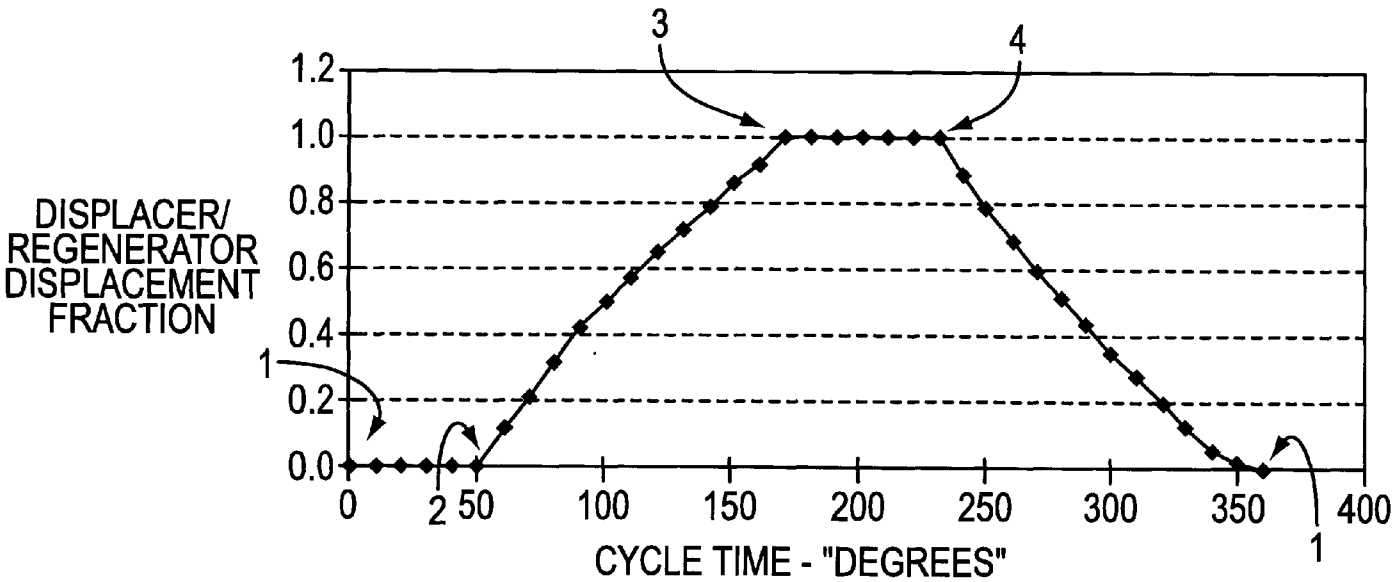
FIG. 6 is a displacement v. time graph for a displacer in the absorber assembly of the present invention.

When the valve 26 opens to the lower pressure at the outlet 24, the high pressure gas in chambers 36, 38, which is at low temperatures due to previous cycles of the apparatus, flows through the regenerator portions of the displacer/regenerator 14, 16 toward the outlet 24. Thus the pressure drops in the chambers 36, 38 although the displacer/regenerator assemblies 14, 16 have not yet moved. Thus the process moves from point 1 to point 2 in FIG. 5, without volume change. (See FIG. 6) Expansion of the gas in the chambers 36, 38 as the pressure drops and the gas flows toward the outlet 24, causes the temperature of the gas to drop and remove heat from heat loads that, in use, are attached to heat stations connected externally to the cylinder assembly 12 at each stage of the displacer/regenerator assembly 14, 16.

Gas continues to flow from the surge volume 34 at Ps through the orifice 32. The pressure differential between Ps and Pl at the outlet 24 pushes the slack cap 48, which pushes the displacer assembly 14, 16 down (right). Low pressure gas continues to flow out of the expander 10' in heat transfer relationship with the heat stations and the regenerators until the displacer drive stem 18', and more particularly the flange 60, hits the second bumper 54, acting through the intermediate retainer 58. This is point 3 of the P-V diagram (FIG. 5), which condition is illustrated physically in FIG. 2*b*. In practice, the rotary valve 26 closes the connection to the low pressure outlet 24 before the displacer assembly 14, 16 reaches the bottom of the stroke so that displacer velocity is reduced before the displacer assembly 14, 16 hits the bumper 54.

Figure 4:
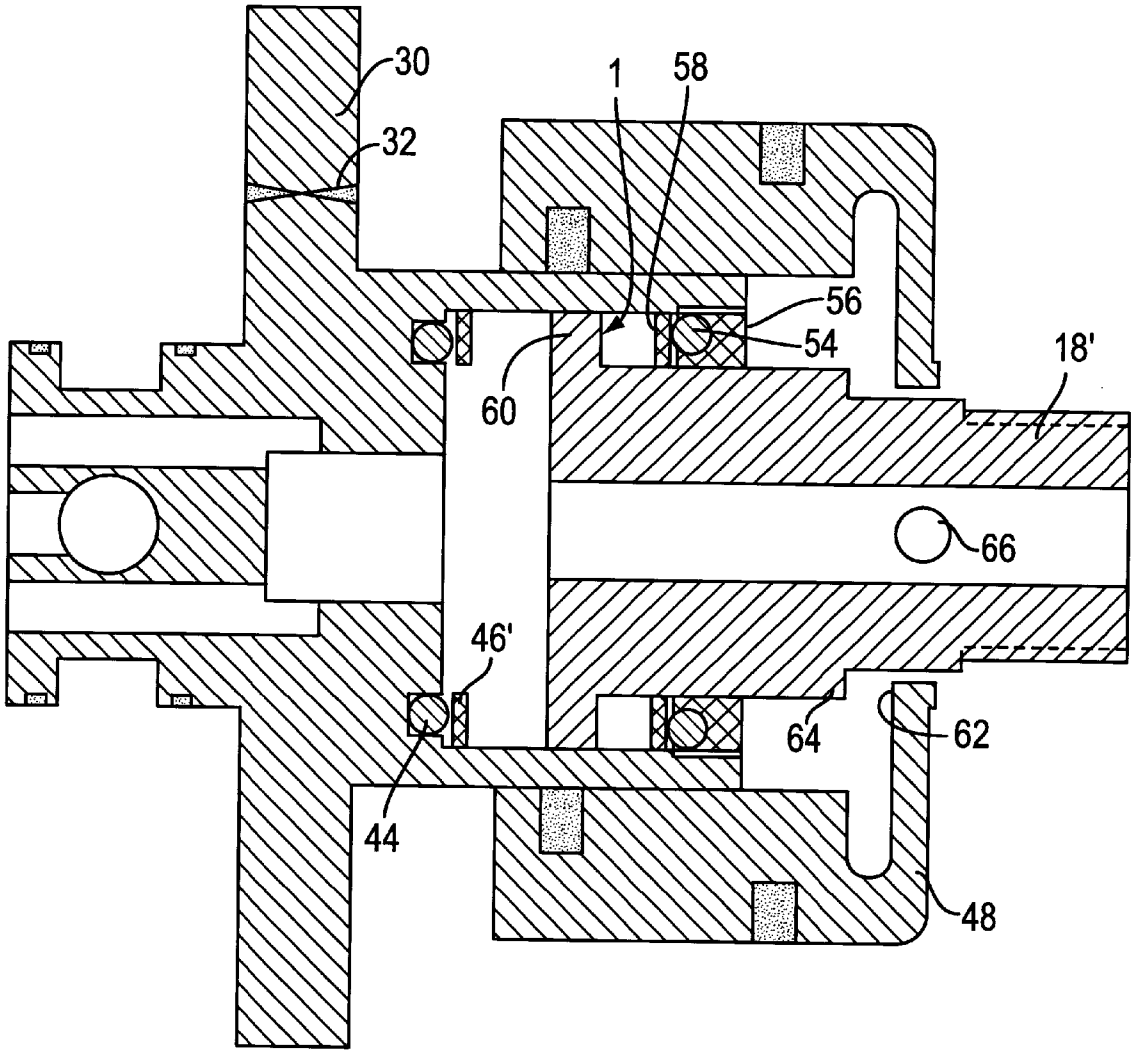
FIG. 4 is an enlarged view, in section, of a bumper assembly in accordance with the invention.

Next, the valve 26 rotates and emits high pressure gas from the inlet 22 to the displacer assemblies 14, 16. Initially, the slack cap 48, having this high pressure gas at its low end and the lower pressure gas Ps from the surge tank 34 at its high end, moves up (left) in FIG. 2*a,b*. But the edge 62 of the slack cap (FIG. 4) does not make contact with, and does not move, the drive stem 18' and the connected displacer/regenerator assembly 14, 16, until contact is made with the drive stem 18' at the shoulder 64 (FIG. 4). Thus the delay before the slack cap 48 engages the drive stem 18' causes the pressure in the chambers 36, 38 and in the regenerators themselves to build up to Ph before the displacer assembly 14, 16 starts to move. This pressure buildup is shown at constant volume from point 3 to point 4 in FIG. 5.

The slack cap 48, continues to move, engages the displacer stem 18' and pulls the displacer assembly 14, 16 up (left) as gas trapped above the slack cap flows into the surge volume 34 through the orifice 32 until the drive stem 18' hits the bumper 44 by way of the intermediate retainer 46. As the inflowing gas pressurizes the regenerator assemblies and the chambers 36, 38, gas flowing down through the regenerators is cooled. Thereby the volumes 36, 38 at the cold ends of the displacer assemblies 14, 16 are filled with cold gas at high pressure. Thus the cycle returns to point 1 of the P-V diagram. The high pressure port by means of the valve 26 closes before the displacer assembly 14, 16 hits the top so that the velocity of the displacer/regenerator assembly 14, 16 is reduced before striking the bumper 44.

With the pressure levels as indicated above, and helium refrigerant gas, temperatures are typically about 10K at the second stage and 30K at the first stage when there is no heat load applied.

FIG. 2*a* mechanically illustrates point 1 of the P-V diagram. The arrows indicate gas flow between points 1 and 2 as gas flows out through the outlet 24.

FIG. 2*b* is the physical condition at point 3 of the P-V diagram. The arrows indicate gas flow patterns during filling of the device between points 3-4-1 of the P-V diagram.

As will be apparent to those skilled in the art, the displacer/regenerator assembly 14, 16 is not caused to translate by gas in the chambers 36, 38 but is pushed down and dragged up by the slack cap 48. The slack cap 48 is acted on at one end, by gases from and to the orifice 32, and by gas from and to the opening 66 in the drive stem 18' at the other end of the slack cap 48.

Those skilled in the art will readily apply the description of operation of the embodiment in accordance with the invention (FIGS. 2*a*, 2*b*) to operation of the embodiment of the prior art illustrated in FIGS. 1*a, b*. Thermodynamically, the two embodiments are substantially similar.

The present construction has the great advantage that the vibration and noise reducing bumpers, 44, 54, are both located at warm portions of the expander device 10' . Thus, both bumpers can be highly resilient, for example, Buna N rubber, "O" rings and the need to use a material of less resilience, for example, delrin, because it had to operate at cryogenic temperatures, is avoided. Reduced vibration and noise are provided.

Physical aspects of an expander in accordance with the invention that provided satisfactory performance were:

Cylinder length—200 mm, $1^{st}$ stage, 135 mm, $2^{nd}$ stage;

Cylinder inside diameter—80 mm, $1^{st}$ stage, 20 mm, $2^{nd}$ stage;

Displacer weight—1700 g;

Operating speed—2.4 Hz (144 rpm), (Displacer Cycles);

"O" ring bumpers—1.11" inside diameter, 0.139" cross section, Buna N. Allowable deflection is 0.035".

In the embodiments described above the absorbers 44, 54 are in fixed positions relative to the cylinder assembly 12. In an alternative embodiment (not shown) in accordance with the invention, the absorbers may move with the displacer assembly 14, 16 and strike against surfaces fixed relative to the cylinder assembly 12. For example, the absorber 54 may be mounted recessed in the flange 60 and impact an opposed flat surface of the flange 56. The absorber 44 may be mounted recessed in the drive stem 18' and impact an opposed flat surface of the valve stem 30.

It will thus be seen that the object set forth above, and those made apparent from the preceding description are efficiently attained and, whereas certain changes may be made in the above constructions without departing from the spirit and scope of the invention, it is intended that all matter contained in the above description and shown in the accompanying drawings shall be interpreted as illustrative and not in a limiting sense.

What is claimed is:

1. An expander of a GM type for use in providing cryogenic refrigeration, comprising:

a cylinder serving as at least one cold head, said cylinder having a longitudinal axis;

a displacer assembly extending axially within said cylinder between a cold zone of said cylinder and a warm zone, said displacer being reciprocatably moveable axially in said cylinder between a first stroke end position and a second stroke end position;

first mechanical means fixed relative to one of said cylinder and said displacer assembly for stopping said reciprocating motion of said displacer assembly in a first axial direction, said displacer assembly stopping at said first end position;

second mechanical means fixed relative to one of said cylinder and displacer assembly for stopping said reciprocating motion of said displacer assembly in a second axial direction at said second end position;

said first mechanical means including a first impact absorber connecting between said cylinder and displacer assembly when said displacer assembly is at said first end position;

said second mechanical means including a second impact absorber connecting between said cylinder and said displacer assembly when said displacer assembly is at said second end position;

said first and second absorbers being located closer to said first end position than to said second end position.

2. An expander as in claim 1, wherein said absorbers are resilient.

3. An expander as in claim 2, where at least one said absorber includes an elastomer material.

4. An expander as in claim 2, wherein said absorbers are fixed in position relative to said cylinder.

5. An expander as in claim 1, wherein said first end position in normal operation of said expander, is at approximately room-ambient temperature.

6. An expander as in claim 3, wherein said elastomer material is in the form of an O-ring.

7. An expander as in claim 1, wherein at said end positions said displacer assembly is axially spaced from expander elements that are one of a portion of said cylinder and fixed in relation to said cylinder.

8. An expander as in claim 1, wherein said first and second absorbers are near the same temperature, said temperature being at or near ambient environment temperature.

9. An expander as in claim 1, further comprising drive means for reciprocating said displacer assembly, said drive means pushing said displacer assembly in a first drive stroke in said first direction and pulling said displacer assembly in a second drive stroke in said second direction.

10. An expander as in claim 9, wherein said drive strokes are greater in axial length than a distance traveled by said displacer assembly in moving between said first end position and said second end position.

11. An expander as in claim 9, wherein said drive means moves relative to said displacer assembly without pushing in an initial portion of said first drive stroke and pushing said displacer assembly for a remainder portion of said first drive stroke.

12. An expander as in claim 9, wherein said drive means moves relative to said displacer assembly without pulling at an initial portion of said second drive stroke and pulls said displacer assembly for a remainder portion of said second drive stroke.

13. An expander as in claim 9, wherein said drive means is moved pneumatically.

* * * * *